US006102160A

United States Patent [19]

Cornelius

[11] Patent Number: 6,102,160

[45] Date of Patent: Aug. 15, 2000

[54] COMPRESSOR LUBRICATION

[75] Inventor: Kenneth Charles Cornelius, Centerville, Ohio

[73] Assignee: Copeland Corporation, Sidney, Ohio

[21] Appl. No.: 09/079,373

[22] Filed: May 15, 1998

[51] Int. Cl.[7] ..... F01M 1/02

[52] U.S. Cl. ..... 184/6.16; 184/43; 418/151

[58] Field of Search ..... 184/6.16, 43; 418/89, 418/94, 151

[56] References Cited

U.S. PATENT DOCUMENTS

| | | | |
|---|---|---|---|
| 0,502,100 | 7/1893 | Krug | 184/43 |
| 1,616,913 | 2/1927 | McCallum | 184/6.16 |
| 3,858,685 | 1/1975 | Bono . | |
| 4,365,941 | 12/1982 | Tojo et al. . | |
| 4,431,356 | 2/1984 | Lassota . | |
| 4,432,693 | 2/1984 | Hackbart . | |
| 4,496,293 | 1/1985 | Nakamura et al. . | |
| 4,592,703 | 6/1986 | Inaba et al. . | |
| 4,702,682 | 10/1987 | Inaba et al. . | |
| 4,702,683 | 10/1987 | Inaba et al. . | |
| 4,747,471 | 5/1988 | Ballentine et al. . | |
| 4,749,344 | 6/1988 | Tomita et al. . | |
| 4,793,778 | 12/1988 | Eiermann . | |
| 4,834,627 | 5/1989 | Gannaway . | |
| 4,875,838 | 10/1989 | Richardson, Jr. . | |
| 4,875,840 | 10/1989 | Johnson et al. . | |
| 4,877,381 | 10/1989 | Johnson et al. . | |
| 4,915,194 | 4/1990 | Englander et al. . | |
| 5,038,891 | 8/1991 | Wallis . | |
| 5,252,039 | 10/1993 | Mangyo et al. . | |
| 5,326,231 | 7/1994 | Pandeya et al. . | |
| 5,380,170 | 1/1995 | Fain . | |
| 5,476,370 | 12/1995 | Wood . | |
| 5,785,151 | 7/1998 | Fry et al. | 184/6.16 |

*Primary Examiner*—David M. Fenstermacher
*Attorney, Agent, or Firm*—Harness, Dickey & Pierce, P.L.C.

[57] ABSTRACT

A lubrication system for a compressor has a first axially extending lubricant passage in the driveshaft located on the axis of rotation of the driveshaft. A second axially extending passage in the driveshaft is located radially outward from the first axially extending lubricant passage. An angular lubricant passage extends between the two axially extending passages. The angular lubricant passage pumps lubricant to the second axially extending passage while gas entrapped within the oil flows through the first axially extending lubricant passage.

25 Claims, 3 Drawing Sheets

COMPRESSOR LUBRICATION

FIELD OF THE INVENTION

The present invention relates generally to lubrication system for compressors. More particularly, the present invention relates to lubrication systems for hermetic refrigeration systems.

BACKGROUND AND SUMMARY OF THE INVENTION

Refrigeration compressors in general and more specifically, refrigeration compressor of the hermetically sealed reciprocating piston type normally include a reservoir of lubricating oil in the lower portion or sump of the sealed shell. A pump of some type is normally provided which operates to circulate oil to the bearings and other components requiring lubrication through oil passages which extend through the compressor's crankshaft. Because the oil is in open communication with the refrigerant of the compressor, it is not uncommon for some of the refrigerant in liquid and/or gaseous form to become mixed with the oil. As the operation of the compressor heats the lubricating oil, a portion of this mixed liquid refrigerant will be boiled off. It is therefore important to have the crankshaft's lubrication passages incorporate a vent of some type to avoid vapor lock which could stop the flow of lubricating oil to the bearings. Additionally, it is also generally desirable to minimize the amount of the intermixing of the lubricating oil and the refrigerant gas at suction pressure flowing to the intake of the compressor in order to prevent slugging of the compressor as well as preventing the carry over of oil into the refrigeration system.

Accordingly, the present invention provides an improved lubrication system which incorporates fluid passages within the crankshaft to effectively vent any gaseous refrigerant from the lubrication oil flowing through the passages yet still ensuring that no lubricating oil is carried over into the primary flow area for the refrigerant at suction pressure to the intake of the compressor. The lubrication system of the present invention ensures full and complete lubrication of all bearing surfaces and the like over a wide range of operating conditions of the compressor.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
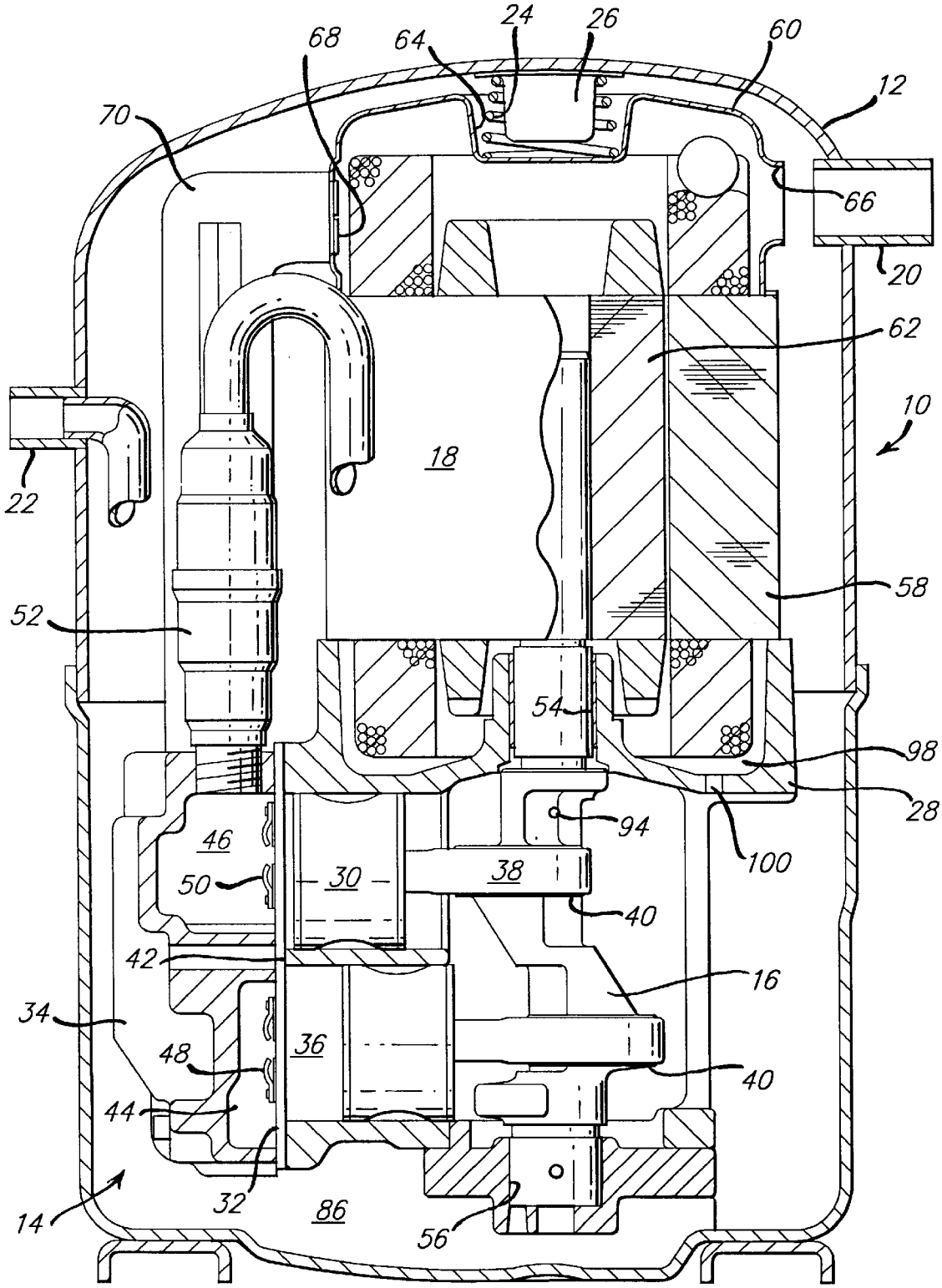
FIG. 1 is a side view, partially in cross-section of a hermetic refrigeration compressor incorporating a lubrication system in accordance with the present invention.
Figure 2:
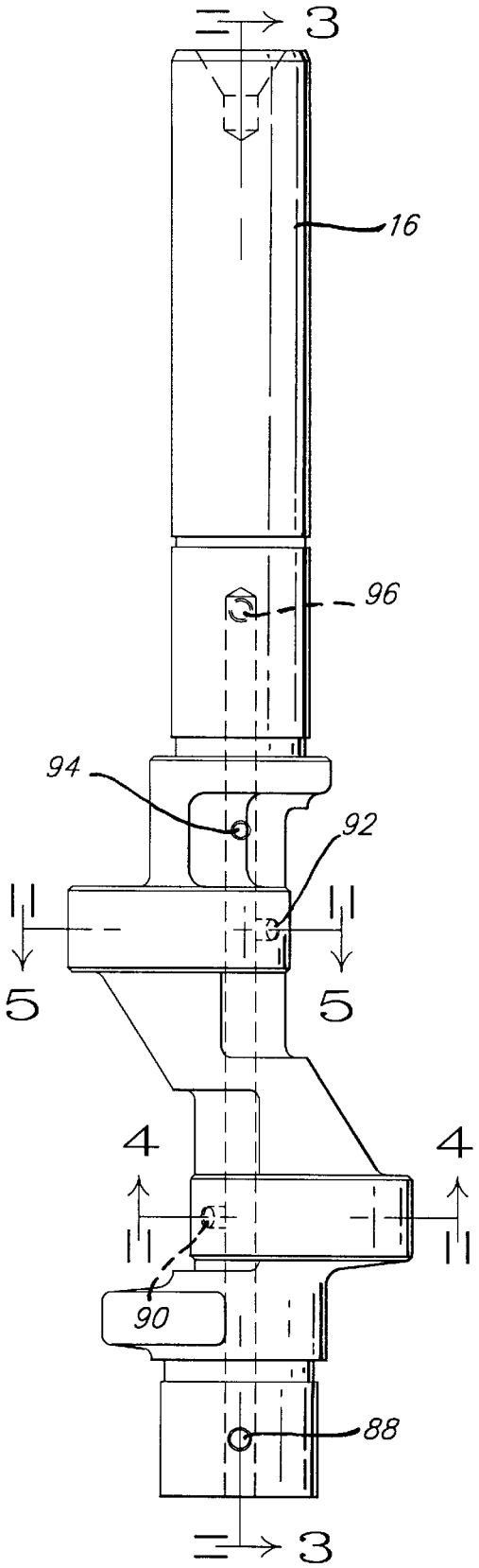
FIG. 2 is a side elevational view of the crankshaft incorporated in the refrigeration compressor shown in FIG. 1.
Figure 3:
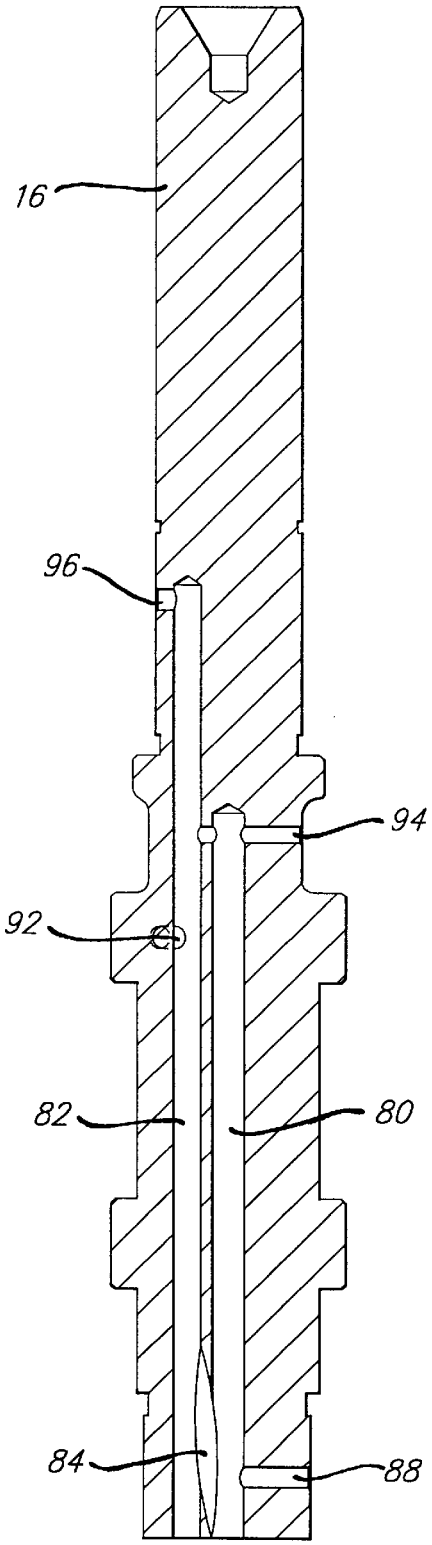
FIG. 3 is a cross-sectional view taken in the direction of arrows 3—3 shown in FIG. 2.
Figure 4:
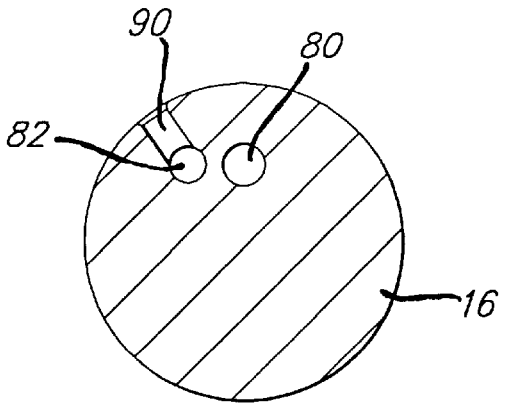
FIG. 4 is a cross-sectional view taken in the direction of arrows 4—4 shown in FIG. 2.
Figure 5:
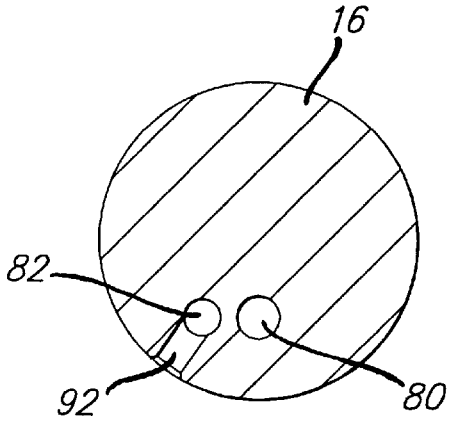
FIG. 5 is a cross-sectional view taken in the direction of arrows 5—5 shown in FIG. 2.
Figure 6:
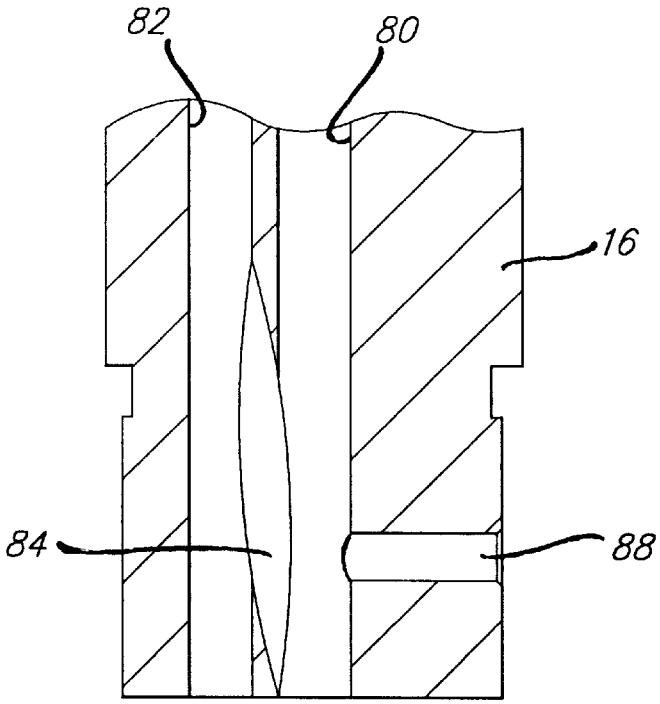
FIG. 6 is an enlarged cross-sectional view of the lower portion of the crankshaft shown in FIG. 3.

Referring now to the drawings in which like reference numerals designate like or corresponding parts throughout the several views, there is shown in FIG. 1 a hermetic reciprocating piston type refrigeration compressor assembly including the improved lubrication system in accordance with the present invention which is designated generally by the reference numeral 10. Compressor assembly 10 comprises an outer shell 12, a compressor 14, a crankshaft 16 and an electric motor 18. Outer shell 12 is a two piece welded assembly which includes a suction gas inlet fitting 20 and a discharge gas outlet fitting 22. The assembly of compressor 14, crankshaft 16 and electric motor 18 is spring supported in the usual manner (not shown) and positioned at their upper end by means of a spring 24 located on a sheet metal projection 26.

Compressor 14 comprises a compressor body 28, a plurality of pistons 30 (two pistons in this case), a valve plate assembly 32 and a cylinder head 34. Compressor body 28 defines a plurality of pumping cylinders 36 (two parallel radially disposed cylinders in this case). Cylinders 36 accept pistons 30 for reciprocal movement within cylinders 36 to form the pumping members for compressor 14. Each piston 30 is connected in the usual manner to crankshaft 16 by a connecting rod 38 using a typical connecting rod bearing 40. Each cylinder 36 in body 28 is opened to an outer planar surface 42 on body 28 to which is bolted valve plate assembly 32 and cylinder head 34 all in the usual manner. Cylinder head 34 defines interconnected discharge gas chambers 44 and 46 which receive the discharge gas pumped by compressor 14 through two discharge valve assemblies 48 and 50, respectively. Discharge gas chambers are in communication with a discharge muffler 52 which is in turn in communication with discharge gas outlet fitting 22.

Crankshaft 16 is rotationally journalled in an upper bearing 54 located within body 28 and in a lower bearing 56 also located within body 28. The upper end of crankshaft 16 is attached to electric motor 18. Motor 18 operates to rotate crankshaft 16 which in turn reciprocates pistons 30 within cylinders 36 in the usual manner to compress the refrigerant gas.

Electric motor 18 is comprised of a motor stator 58, a motor cover 60 and a motor rotor 62. Motor stator 58 is secured to compressor body 28 by welding or by a plurality of bolts (not shown) in the usual manner. Motor cover 60 is attached to motor stator 58 by welding or by the plurality of bolts in the usual manner. Motor cover 60 defines a recess 64 for receiving spring 24, an inlet opening 66 and an outlet 68. Inlet opening 66 is positioned to receive suction gas entering shell 12 through inlet fitting 20 for purposes of cooling motor 18 prior to induction into cylinders 36. Outlet 68 is in communication with a suction muffler 70 which provides refrigerant at suction pressure to compressor 14. Motor rotor 62 is attached to the upper end of crankshaft 16 to cause the rotation of crankshaft 16 and the pumping of compressor 14.

Referring now to FIGS. 2–6, crankshaft 16 incorporates a centrifugal oil pumping means in the form of a first axially inwardly extending bore 80, a second axially inwardly extending bore 82 and an angled cross bore 84. Bore 80 is positioned in coaxial relationship to the axis of rotation of crankshaft 16 and is open at the lower end of crankshaft 16. Bore 80 is in open communication with an oil sump 86 located in the bottom of shell 12. Bore 82 is positioned in radial offset relationship to the axis of rotation of crankshaft 16 and is open at the lower end of crankshaft 16. Angled cross bore 84 connects bore 80 with bore 82 to feed lubricant oil from sump 86 through bore 80 to bore 82.

A lower bearing bore 88 extends radially from bore 80 through the outer surface of crankshaft 16 in line with lower bearing 56 to provide lubricating oil to bearing 56. A lower crank bearing bore 90 extends angularly from bore 82 through the outer surface of crankshaft 16 in line with the lower connecting rod bearing 40 to provide lubricating oil to lower bearing 40. The circumferential and angular position of bore 90 facilitates the lubrication of lower bearing 40. An upper crank bearing bore 92 extends angularly from bore 82 through the outer surface of crankshaft 16 in line with the upper connecting rod bearing 40 to provide lubricating oil to upper bearing 40. The circumferential and angular position of bore 92 facilitates the lubrication of upper bearing 40. A venting bore 94 extends radially from bore 82 across the axis of crankshaft 16 through bore 80 and through the outer surface of crankshaft 16 to communicate with the interior of outer shell 12 to vent refrigeration gas from the lubricating oil as will be described later herein. An upper bearing bore 96 extends radially from bore 82 through the outer surface of crankshaft 16 in line with upper bearing 54 to provide lubricating oil to bearing 54.

Bores 80, 82 and 84 are the primary oil lubrication supply system for compressor 14 and function to supply lubricating oil to bores 88, 90, 92 and 96 for lubricating bearing 56, lower bearing 40, upper bearing 40 and bearing 54, respectively. Bore 80 in conjunction with vent bore 94 avoids the accumulation of trapped refrigerant gas within the lubricating oil which could possibly prevent adequate lubrication flow from bore 80 to bore 82 through cross bore 84.

Motor 18 rotates crankshaft 16 causing bore 80 located along the axis of rotation of crankshaft 16 to become a centrifugal pump. Lubricating oil along with entrapped refrigerant gas within oil sump 86 is drawn up into bore 80 towards bore 94. The diameter of bore 80 along with the coaxial position of bore 80 will only pump lubrication oil a portion of the way up bore 80 leaving the upper portion of bore 80 and vent bore 94 free of oil allowing for the venting of the gas entrapped within the oil. The centrifugal action of the oil within bore 80 will cause a radial inner and outer stratification between the lubricating oil and the entrapped refrigerant gas. Thus, the lubricating oil will be thrown to the outer portion of bore 80 while the lighter entrapped refrigerant gas will flow radially inward from the lubricating oil. As the lubricating oil and the entrapped gas flow up bore 80, lubricating oil from the outer portion of bore 80 will feed through angled bore 84 into bore 82. Thus, the lubricating oil being fed to bore 82 will include a significant reduction in the amount of refrigerant gas. In addition, lubricating oil flowing up bore 80 will feed through bore 88 to lubricate lower bearing 56. Again, the lubricating oil being fed to bore 88 will be from the outer portion of bore 80 and thus will have a reduce amount of entrapped refrigerant gas. The oil being pumped up bore 80 will only travel a portion of the distance toward bore 94 due to the reduced diameter of bore 80. The gas which is entrapped within the oil will separate from the oil and continue up bore 80 to bore 94 where it will be vented to the crankcase within shell 12. The angled configuration of bore 84 is also positioned within sump 86 and is thus at least partially filled with lubricating oil. This oil in conjunction with the oil being fed to bore 84 from bore 80 is pumped, due to the angled configuration of bore 84, through bore 84 and into bore 82. Thus, bore 84 functions as the primary pump for lubrication oil for compressor 10. Due to the centrifugal action within bore 80, the lubricating oil pumped by bore 84 will have a significant reduction in the amount of entrapped gas.

Lubricating oil flowing into bore 82 from bore 84 will flow up bore 82 and out of bore 90 to lubricate lower crank pin bearing 40, out of bore 92 to lubricate upper crank pin bearing 40 and out of bore 96 to lubricate upper bearing 54. Lubricating oil flowing past both lower and upper bearings 40 will immediately be returned to sump 86. Lubricating oil flowing past upper bearing 54 will flow to a motor cavity 98 formed by compressor body 28 and back to sump 86 through an oil return hole 100. Thus, none of the lubricating oil that is pumped by the lubrication system of the present invention is located in the vicinity of motor cover 60, inlet opening 66 and outlet 68. This flow of oil will serve to limit the potential for oil to be pumped into the suction gas flow path within the motor area and hence reduce the potential mixing and carry over of the oil into the refrigeration system.

Vent bore 94 extends from bore 82, through bore 80 and through the outer surface of crankshaft 16. Vent bore 94 thus vents gas separating from the oil located within bore 80. Vent bore 94 also operates to vent any trapped gas which may accumulate within bore 82 which might reduce the pumping of the lubricating oil through bore 82. Bore 94 extends across the centerline of crankshaft 16 and thus there is no pumping of lubricating oil from bore 82 to vent bore 94. Should a packet of trapped gas become trapped within bore 82, it would be vented to the crankcase within shell 12 through bore 94 as soon as the pocket of trapped gas reached bore 94. This lubrication system thus ensures a continuous supply of lubricant to all of the bearings associated with crankshaft 16.

While the above detailed description describes the preferred embodiment of the present invention, it should be understood that the present invention is susceptible to modification, variation and alteration without deviating from the scope and fair meaning of the subjoined claims.

What is claimed is:

1. A compressor assembly comprising:

an outer shell defining a lubricant sump;

a compressor disposed within said shell;

a drive shaft having an axis of rotation for driving said drive shaft having one end extending into said sump;

a first bearing for rotatably supporting said drive shaft;

a motor operatively connected to said drive shaft;

a lubrication system for said compressor assembly, said lubrication system comprising:

a first axially extending passage within said drive shaft, said first axially extending passage having a first inlet disposed within said lubricant sump;

a second axially extending passage within said drive shaft, said second axially extending passage having a second inlet disposed within said lubricant sump, said second inlet being separate from said first inlet, said first and second axially extending passages transport lubricant from said lubricant sump, said first and second axially extending passages transporting lubricant from the lubricant sump; and an angular passage extending between said first and said second axially extending passages.

2. The compressor assembly according to claim 1 wherein, said angular passage is open to said lubricant sump.

3. The compressor assembly according to claim 2 wherein, said first axially extending passage defines a central axis, said central axis being disposed along said axis of rotation of said driveshaft.

4. The compressor assembly according to claim 3 wherein, said second axially extending passage is disposed radially outward from said first axially extending passage.

5. The compressor assembly according to claim 4 wherein, said lubrication system further comprises a first radial bore disposed between said first axially extending passage and said first bearing.

6. The compressor assembly according to claim 5 wherein, said compressor assembly further comprises a second bearing for rotatably supporting said driveshaft and said lubrication system further comprises a second radial bore disposed between said second axially extending passage and said second bearing.

7. The compressor assembly according to claim 6 wherein, said lubrication system further comprises a venting bore disposed between said first axially extending passage and said sump.

8. The compressor assembly according to claim 7 wherein, said venting bore extends between said first and second axially extending bores.

9. The compressor assembly according to claim 1 wherein, said first axially extending passage defines a central axis, said central axis being disposed along said axis of rotation of said driveshaft.

10. The compressor assembly according to claim 9 wherein, said second axially extending passage is disposed radially outward from said first axially extending passage.

11. The compressor assembly according to claim 10 wherein, said lubrication system further comprises a first radial bore disposed between said first axially extending passage and said first bearing.

12. The compressor assembly according to claim 11 wherein, said compressor assembly further comprises a second bearing for rotatably supporting said driveshaft and said lubrication system further comprises a second radial bore disposed between said second axially extending passage and said second bearing.

13. The compressor assembly according to claim 12 wherein, said lubrication system further comprises a venting bore disposed between said first axially extending passage and said sump.

14. The compressor assembly according to claim 13 wherein, said venting bore extends between said first and second axially extending bores.

15. The compressor assembly according to claim 1 wherein, said second axially extending passage is disposed radially outward from said first axially extending passage.

16. The compressor assembly according to claim 15 wherein, said lubrication system further comprises a first radial bore disposed between said first axially extending passage and said first bearing.

17. The compressor assembly according to claim 16 wherein, said compressor assembly further comprises a second bearing for rotatably supporting said driveshaft and said lubrication system further comprises a second radial bore disposed between said second axially extending passage and said second bearing.

18. The compressor assembly according to claim 17 wherein, said lubrication system further comprises a venting bore disposed between said first axially extending passage and said sump.

19. The compressor assembly according to claim 18 wherein, said venting bore extends between said first and second axially extending bores.

20. The compressor assembly according to claim 1 wherein, said lubrication system further comprises a first radial bore disposed between said first axially extending passage and said first bearing.

21. The compressor assembly according to claim 20 wherein, said compressor assembly further comprises a second bearing for rotatably supporting said driveshaft and said lubrication system further comprises a second radial bore disposed between said second axially extending passage and said second bearing.

22. The compressor assembly according to claim 21 wherein, said lubrication system further comprises a venting bore disposed between said first axially extending passage and said sump.

23. The compressor assembly according to claim 22 wherein, said venting bore extends between said first and second axially extending bores.

24. The compressor assembly according to claim 1 wherein, said lubrication system further comprises a venting bore disposed between said first axially extending passage and said sump.

25. The compressor assembly according to claim 24 wherein, said venting bore extends between said first and second axially extending bores.

* * * * *

UNITED STATES PATENT AND TRADEMARK OFFICE

CERTIFICATE OF CORRECTION

PATENT NO. : 6,102,160
DATED : August 15, 2000
INVENTOR(S) : Kenneth Charles Cornelius It is certified that error appears in the above-identified patent and that said Letters Patent is hereby corrected as shown below:

Column 4,
Line 35, after "said" insert -- compressor, said --.
Lines 49 and 50, delete "said first and second axially extending passages transport lubricant from said lubricant sump".

Signed and Sealed this

Second Day of October, 2001

*Attest:*

Nicholas P. Godici

*Attesting Officer*

NICHOLAS P. GODICI
*Acting Director of the United States Patent and Trademark Office*